US009343019B2

(12) United States Patent
Lin et al.

(10) Patent No.: US 9,343,019 B2
(45) Date of Patent: May 17, 2016

(54) TRANSFLECTIVE DISPLAY APPARATUS AND OPERATION METHOD THEREOF

(71) Applicant: AU OPTRONICS CORP., Hsin-Chu (TW)

(72) Inventors: Yen-Feng Lin, Hsin-Chu (TW); Han-Zheng Liu, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 45 days.

(21) Appl. No.: 14/330,259

(22) Filed: Jul. 14, 2014

(65) Prior Publication Data

US 2015/0325204 A1 Nov. 12, 2015

(30) Foreign Application Priority Data

May 8, 2014 (TW) ..... 103116417 A

(51) Int. Cl.

| | |
|---|---|
| ***G09G 3/36*** | (2006.01) |
| ***G09G 5/10*** | (2006.01) |
| ***G09G 5/02*** | (2006.01) |
| ***G09G 5/18*** | (2006.01) |

(52) U.S. Cl.

CPC ..... *G09G 3/36* (2013.01); *G09G 3/3696* (2013.01); *G09G 5/02* (2013.01); *G09G 5/10* (2013.01); *G09G 5/18* (2013.01); *G09G 2300/04* (2013.01); *G09G 2300/0456* (2013.01)

(58) Field of Classification Search

CPC ..... G09G 5/02; G09G 5/10; G09G 5/18; G09G 3/3696; G09G 2300/04; G09G 2300/0456; G09G 2300/046; G02F 2203/09

See application file for complete search history.

(56) References Cited

U.S. PATENT DOCUMENTS

| | | | | |
|---|---|---|---|---|
| 6,295,109 | B1 * | 9/2001 | Kubo | G02F 1/133371 349/117 |
| 7,639,324 | B2 * | 12/2009 | Nakayoshi | G02F 1/133615 349/106 |
| 8,009,130 | B2 * | 8/2011 | Kim | G09G 3/3648 345/210 |
| 8,072,403 | B2 * | 12/2011 | Hsieh | G02F 1/133371 345/87 |
| 8,643,683 | B2 * | 2/2014 | Chang | G09G 3/3413 345/690 |

(Continued)

FOREIGN PATENT DOCUMENTS

| | | | |
|---|---|---|---|
| CN | 103185979 | A | 7/2013 |
| TW | I288382 | B | 10/2007 |

OTHER PUBLICATIONS

State Intellectual Property Office of the People's Republic of China, "Office Action" issued on Dec. 3, 2015.

*Primary Examiner* — Tom Sheng
(74) *Attorney, Agent, or Firm* — WPAT, PC; Justin King

(57) ABSTRACT

A transflective display apparatus and an operation method thereof are provided. The transflective display apparatus includes a transflective display panel and a backlight module. The transflective display panel includes a plurality of pixels. Each pixel includes a plurality of sub-pixels with different colors. Each sub-pixel includes a transparent area and a reflective area. The operation method includes: determining whether the transflective display apparatus is operated in a reflective mode or not; and driving, when the transflective display apparatus is determined being operated in the reflective mode, the transflective display panel by way of driving at least one of the plurality of sub-pixels in each pixel each time and turning off the backlight module, thereby facilitating the transflective display apparatus to display an image by using the reflective areas of the driven sub-pixels to reflect an ambient light of the transflective display apparatus.

20 Claims, 4 Drawing Sheets

(56) References Cited

U.S. PATENT DOCUMENTS 8,767,021 B2 * 7/2014 Miyake ..... G02F 1/133555 345/690
8,773,338 B2 * 7/2014 Miyake ..... G09G 3/3648 345/204
2005/0068482 A1 * 3/2005 Kume ..... G02F 1/1393 349/130
2005/0275933 A1 * 12/2005 Johnson ..... G02F 1/167 359/296
2006/0044240 A1 * 3/2006 Takizawa ..... G02F 1/133514 345/88
2006/0221276 A1 * 10/2006 Masumoto ..... G02F 1/133555 349/114
2007/0242014 A1 * 10/2007 Lee ..... G02F 1/133514 345/88
2008/0055519 A1 * 3/2008 Battersby ..... G09G 3/3648 349/68
2008/0068523 A1 * 3/2008 Mitsui ..... G02F 1/133555 349/37
2008/0225062 A1 9/2008 Chang et al.
2008/0231781 A1 * 9/2008 Ge ..... G02F 1/133553 349/113
2010/0014032 A1 * 1/2010 Jepsen ..... G02F 1/133514 349/114
2010/0020054 A1 * 1/2010 Jepsen ..... G09G 3/3685 345/208
2010/0220096 A1 * 9/2010 Hyytiainen ..... G02F 1/133555 345/214
2011/0102476 A1 5/2011 Chang
2011/0286073 A1 * 11/2011 Lo ..... G02B 26/005 359/290
2013/0027444 A1 * 1/2013 Chui ..... G02B 26/001 345/694
2013/0082607 A1 * 4/2013 Gandhi ..... G09G 3/3413 315/153

* cited by examiner

TRANSFLECTIVE DISPLAY APPARATUS AND OPERATION METHOD THEREOF

TECHNICAL FIELD

The present disclosure relates to a display apparatus and an operation method thereof, and more particularly to a transflective display apparatus and an operation method thereof.

BACKGROUND

Most of the electronic products in market use the liquid crystal displays (LCDs) as display screen elements. However, with a restriction of the material properties of the liquid crystals, a previous image may be still displayed in the currently-displaying image when the liquid crystals are driven for a relatively long time for continuously displaying the same previous image; which is called the image sticking (IS) issue.

Generally, in order to avoid the image sticking issue, LCD display panel may automatically enter into a standby mode or display a specific video after being in idle for a while, thereby preventing the liquid crystals from being continuously driven by the same voltage. However, the aforementioned mechanism may not apply to the electronic products designed for displaying a same image for a relatively long time; such as the smart watch, which is a wearable mobile device equipped with a LCD display panel.

SUMMARY

An object of the present disclosure is to provide an operation method of a transflective display apparatus. By using the operation method, the electronic product (e.g., smart watch) equipped with the transflective display apparatus and designed for displaying a same image for a long time can be prevented from the image sticking issue.

Another object of the present disclosure is to provide the aforementioned transflective display apparatus.

The present disclosure discloses an operation method of a transflective display apparatus. The transflective display apparatus includes a transflective display panel and a backlight module. The transflective display panel includes a plurality of pixels. Each pixel includes a plurality of sub-pixels with different colors. Each sub-pixel includes a transparent area and a reflective area. The operation method includes: determining whether the transflective display apparatus is operated in a reflective mode or not; and driving, when the transflective display apparatus is determined being operated in the reflective mode, the transflective display panel by way of driving at least one of the plurality of sub-pixels in each pixel each time and turning off the backlight module, thereby facilitating the transflective display apparatus to display an image by using the reflective areas of the driven sub-pixels to reflect an ambient light of the transflective display apparatus.

The present disclosure further discloses a transflective display apparatus, which includes a backlight module, a transflective display panel, a scan driver, a data driver and a timing controller circuit. The transflective display panel includes a plurality of pixels. Each one of the plurality of pixels includes a plurality of sub-pixels with different colors. Each one of the plurality of sub-pixels includes a transparent area and a reflective area. The scan driver is electrically coupled to the plurality of sub-pixels. The data driver is electrically coupled to the plurality of sub-pixels. The timing controller circuit is electrically coupled to the backlight module, the scan driver and the data driver. The timing controller circuit is configured to determine whether the transflective display apparatus is operated in a reflective mode or not. Specifically, when the transflective display apparatus is determined being operated in the reflective mode, the timing controller circuit is further configured to drive, through the scan driver and the data driver, the transflective display panel by way of driving at least one of the plurality of sub-pixels in each pixel each time and turn off the backlight module, thereby facilitating the transflective display apparatus to display an image by using the reflective areas of the driven sub-pixels to reflect an ambient light of the transflective display apparatus.

In summary, by driving at least one sub-pixel in each pixel of the transflective display panel each time, the transflective display apparatus and an operation method thereof of the present disclosure can be prevented from having the image sticking issue.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
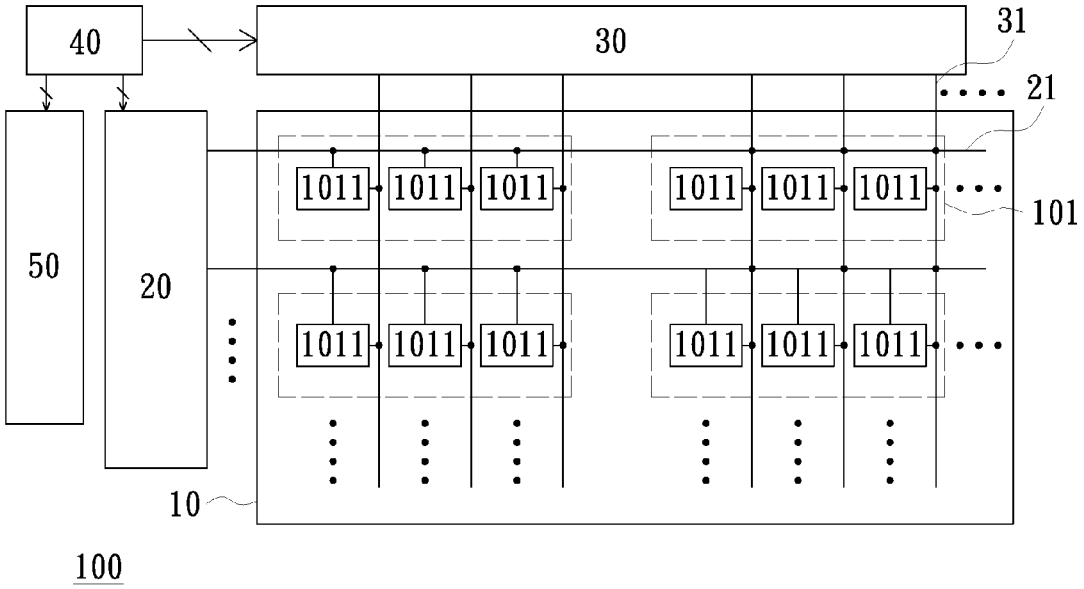
FIG. 1 is a schematic view of a transflective display apparatus in accordance with an embodiment of the present disclosure.

FIG. 1 is a schematic view of a transflective display apparatus in accordance with an embodiment of the present disclosure. As shown, the transflective display apparatus 100 in the present embodiment includes a transflective display panel 10, a scan driver 20, a data driver 30, a timing controller circuit 40 and a backlight module 50. The transflective display panel 10 includes a plurality of pixels 101. Each pixel 101 includes a plurality of sub-pixels 1011 with different colors. Each sub-pixel 1011 includes a transparent area 1012 (shown in FIGS. 3, 4 and will be described in detail later) and a reflective area 1013 (shown in FIGS. 3, 4 and will be described in detail later). The scan driver 20 is electrically coupled to each row of sub-pixels 1011 through a plurality of scan lines 21. The data driver 30 is electrically coupled to each column of sub-pixels 1011 through a plurality of data lines 31. The timing control circuit 40 is electrically coupled to the scan driver 20, the data driver 30 and the backlight module 50.

The transflective display apparatus 100 of the present disclosure can be operated in two different modes, which are the reflective mode and the transparent mode. The timing control circuit 40 is configured to determine that the transflective display apparatus 100 is operated in the reflective mode or the transparent mode. When determining that the transflective display apparatus 100 is operated in the reflective mode, the timing control circuit 40 is further configured to drive, through the scan driver 20 and the data driver 30, the transflective display panel 10 by way of driving at least one of the plurality of sub-pixels 1011 in each pixel 101 each time.

Figure 2:
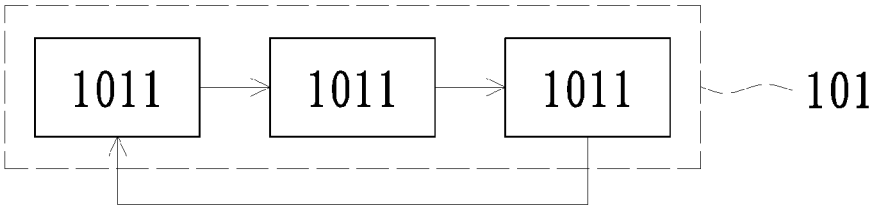
FIG. 2 is a schematic view illustrating one exemplary way to drive the sub-pixels in each pixel when the transflective display apparatus of FIG. 1 is operated in the reflective mode.

FIG. 2 is a schematic view illustrating one exemplary way to drive the sub-pixels 1011 in each pixel 101 when the transflective display apparatus 100 is operated in the reflective mode. As shown, each pixel 101 is exemplified to have three sub-pixels 1011; and the three sub-pixels 1011 are sequentially driven according to the order indicated by the arrows. For example, the left sub-pixel 1011 is driven first for one specific time (for example, one minute); then, the middle sub-pixel 1011 is driven for another specific time (for example, one minute); and then, the right sub-pixel 1011 is driven for another specific time (for example, one minute). However, it is understood that the driving time for each sub-pixel 1011 is adjustable, and the present disclosure is not limited to one minute. In addition, it is understood that the aforementioned driving sequence of the sub-pixels 1011 in each pixel 101 as illustrated in FIG. 2 is for an exemplary purpose only; and the present disclosure is not limited thereto. In another embodiment, the driving sequence of the sub-pixels 1011 in each pixel 101 may have a random manner. In addition, the number of sub-pixels 1011 to be driven in each pixel 101 each time is adjustable. For example, in another embodiment, two of the plurality of sub-pixels 1011 in each pixel 101 are selected to be simultaneously driven each time.

Figure 3:
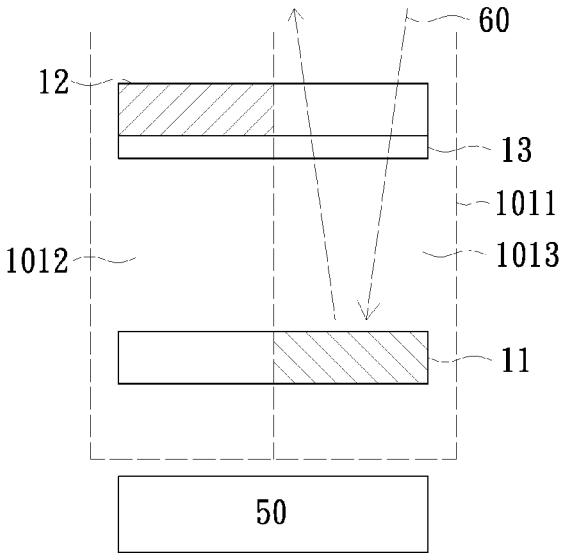
FIG. 3 is a schematic cross-sectional view of the sub-pixel while the transflective display apparatus of FIG. 1 is operated in the reflective mode in accordance with an embodiment of the present disclosure.

FIG. 3 is a schematic cross-sectional view of the sub-pixel 1011 while the transflective display apparatus 100 is operated in the reflective mode in accordance with an embodiment of the present disclosure. As shown, each sub-pixel 1011 includes a lower electrode 11, a photoresist layer 12 and an upper electrode 13. Specifically, the photoresist layer 12 is disposed on the upper electrode 13; and the backlight module 50 is disposed under the lower electrode 11. When the transflective display apparatus 100 is operated in the reflective mode, the backlight module 50 is turned off by the timing control circuit 40 and the transflective display apparatus 100 is configured to use the reflective areas 1013 of the driven sub-pixels 1011 to reflect the ambient light 60 around the transflective display apparatus 100, thereby displaying a single-color image. Specifically, first, the ambient light 60 is emitted from the external of the transflective display panel 10 into the transparent area (indicated by the no slash line, FIG. 3) of the photoresist layer 12; then emitted into the liquid crystal layer (not shown) of the reflective area 1013 through the upper electrode 13; then reflected by the reflective area (indicated by the slash lines, FIG. 3) of the lower electrode 11; and then emitted out from the transflective display panel 10 sequentially through the liquid crystal layer, the upper electrode 13 and the transparent area of the photoresist layer 12, thereby facilitating the transflective display apparatus 100 operated in the respective mode to display a single-color image (i.e., a black-and-white image). In one embodiment, the aforementioned reflective area of the lower electrode 11 is implemented by coating some specific materials (for example, aluminum) having certain reflective properties on a specific area of the lower electrode 11. Further, in one embodiment, the aforementioned transparent area of the photoresist layer 12 may be made by photoresist material having a specific color, so that the ambient light 60 reflected by and emitted out from the transflective display panel 10 can have the specific color.

As described above, when determining that the transflective display apparatus 100 is operated in the reflective mode, the timing control circuit 40 is configured to drive, through the scan driver 20 and the data driver 30, the transflective display panel 10 by way of driving at least one of the plurality of sub-pixels 1011 in each pixel 101 each time; wherein the sequence and the number of the sub-pixel(s) 1011 to be driven in each pixel 101 are adjustable. In one embodiment, for increasing the brightness of an image, the timing control circuit 40 is configured to drive, through the scan driver 20 and the data driver 30, the transflective display panel 10 by way of simultaneously driving two of the plurality of sub-pixels 1011 in each pixel 101 each time. Because there are two sub-pixels 1011 being simultaneously driven in each pixel 101 each time, the transflective display apparatus 100 of the present disclosure has an increased brightness. Further, in one embodiment, the sub-pixels 1011 to be simultaneously driven in each pixel 101 each time may be selected in a random manner.

Alternatively, when determining that the transflective display apparatus 100 is operated in the transparent mode instead of the reflective mode, the timing control circuit 40 is configured to drive, through the scan driver 20 and the data driver 30, the transflective display panel 10 by way of simultaneously driving all of the sub-pixels 1011 in each pixel 101 each time.

Figure 4:
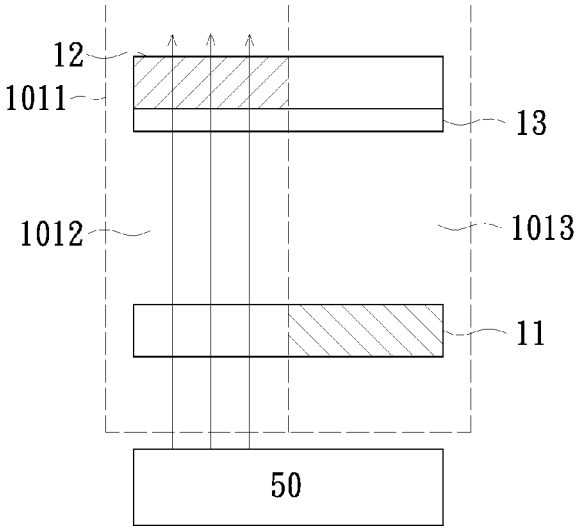
FIG. 4 is a schematic cross-sectional view of the sub-pixel while the transflective display apparatus of FIG. 1 is operated in the transparent mode in accordance with an embodiment of the present disclosure.

FIG. 4 is a schematic cross-sectional view of the sub-pixel 1011 while the transflective display apparatus 100 is operated in the transparent mode in accordance with an embodiment of the present disclosure. As described above, each sub-pixel 1011 includes a lower electrode 11, a photoresist layer 12 and an upper electrode 13. Specifically, the photoresist layer 12 is disposed on the upper electrode 13; and the backlight module 50 is disposed under the lower electrode 11. When the transflective display apparatus 100 is operated in the transparent mode, the backlight module 50 is turned on by the timing control circuit 40 to emit light (for example, white light) out from the transflective display panel 10 sequentially through the transparent area (indicated by no slash line, FIG. 4) of the lower electrode 11, the liquid crystal layer (not shown) of the transparent area 1012, the upper electrode 13 and the color area (indicated by the slash lines, FIG. 4) of the photoresist layer 12, thereby facilitating the transflective display apparatus 100 operated in the transparent mode to display a colorful image. In one embodiment, the photoresist layer 12 is implemented with a color filter film or any element having filter effect. Therefore, a colorful image is displayed by the transflective display panel 10 when the transflective display apparatus 100 is operated in the transparent mode.

In one embodiment, the data voltage of the sub-pixel 1011 in the reflective mode is configured to 5V; the data voltage of the sub-pixel 1011 in the transparent mode is configured to 3.8V; however, it is understood that the aforementioned voltage values are adjustable and the present disclosure is not limited thereto. In addition, for power saving, the frame rate of the transflective display panel 10 may be updated to 48 Hz when the transflective display apparatus 100 is operated in the transparent or reflective mode.

To facilitate the voltage difference between the data voltage received by these un-driven sub-pixels 1011 and the common voltage of these un-driven sub-pixels 1011 to zero when the transflective display apparatus 100 is operated in the reflective mode, in one embodiment the timing control circuit 40 is configured to turn off these un-driven sub-pixels 1011 through the scan driver 20. Or, in another embodiment, the timing control circuit 40 is configured to turn on these un-driven sub-pixels 1011 through the scan driver 20 but at the same time turn off the data driver 30. Or, in still another embodiment, the timing control circuit 40 is configured to turn on these un-driven sub-pixels 1011 through the scan driver 20 and control the data driver 30 to provide a specific data voltage to each un-driven sub-pixel 1011; wherein this specific data voltage has a zero voltage difference with the common voltage of these un-driven sub-pixels 1011.

Figure 5:
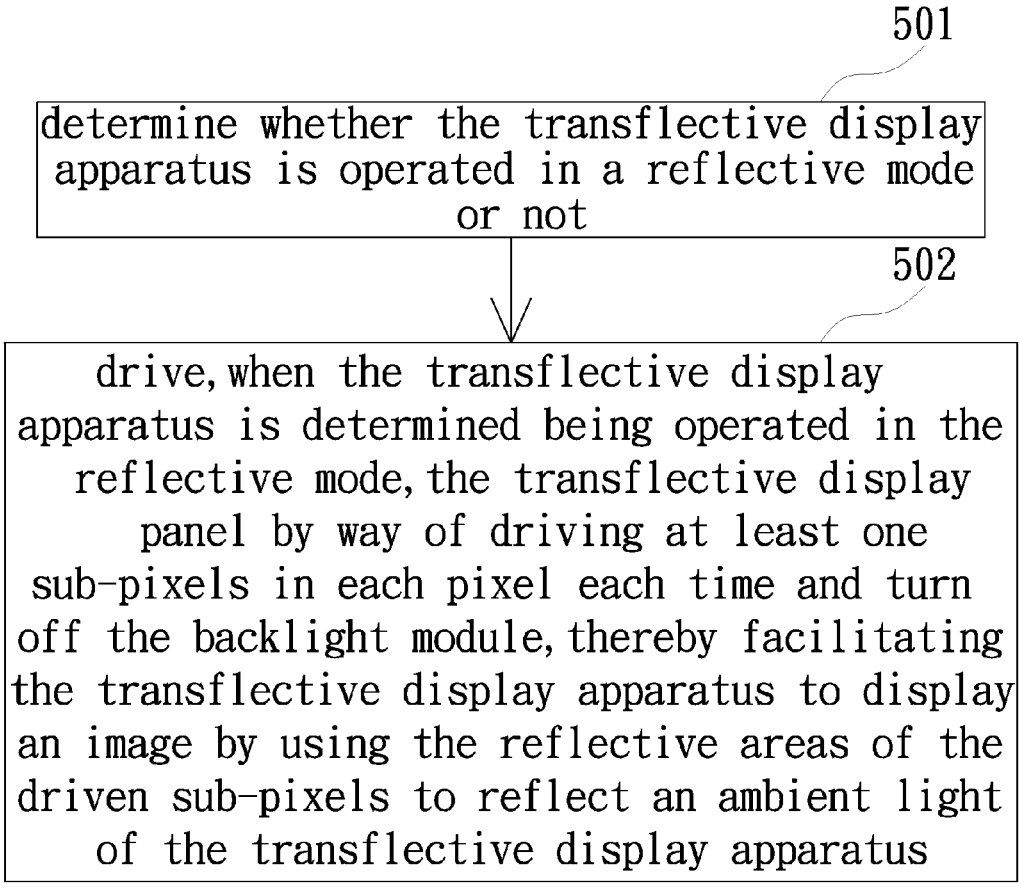
FIG. 5 is a flow chart illustrating an operation method of a transflective display apparatus in accordance with an embodiment of the present disclosure.

FIG. 5 is a flow chart illustrating an operation method of the transflective display apparatus of FIG. 1 in accordance with an embodiment of the present disclosure. Please refer to FIGS. 1, 5. As shown, the operation method includes steps of: determining whether the transflective display apparatus 100 is operated in a reflective mode or not (step 501); and driving, when the transflective display apparatus 100 is determined being operated in the reflective mode, the transflective display panel 10 by way of driving at least one of the plurality of sub-pixels 1011 in each pixel 101 each time and turning off the backlight module 50, thereby facilitating the transflective display apparatus 100 to display an image by using the reflective areas of the driven sub-pixels 1011 to reflect an ambient light 60 of the transflective display apparatus 100.

In summary, by driving at least one sub-pixel in each pixel of the transflective display panel each time, the transflective display apparatus and an operation method thereof of the present disclosure can be prevented from having the image sticking issue.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An operation method of a transflective display apparatus, the transflective display apparatus comprising a transflective display panel and a backlight module, the transflective display panel comprising a plurality of pixels, each one of the plurality of pixels comprising a plurality of sub-pixels with different colors, and each one of the plurality of sub-pixels comprising a transparent area and a reflective area, the operation method comprising:

determining whether the transflective display apparatus is operated in a reflective mode or not; and driving, when the transflective display apparatus is determined being operated in the reflective mode, the transflective display panel by way of driving at least one of the plurality of sub-pixels in each pixel each time and turning off the backlight module, thereby facilitating the transflective display apparatus to display an image by using the reflective areas of the driven sub-pixels to reflect an ambient light of the transflective display apparatus.

2. The operation method according to claim 1, wherein when being operated in the reflective mode, the transflective display apparatus is configured to display a single-color image.

3. The operation method according to claim 1, wherein when the transflective display apparatus is operated in the reflective mode, the at least one sub-pixel to be driven in each pixel each time is selected in a random manner.

4. The operation method according to claim 1, wherein when the transflective display apparatus is operated in the reflective mode, one of the plurality of sub-pixels in each pixel is selected for being driven each time, wherein the selection of the one sub-pixel to be driven in each pixel is based on a specific sequence.

5. The operation method according to claim 1, wherein when the transflective display apparatus is operated in the reflective mode, two of the plurality of sub-pixels in each pixel are selected for being simultaneously driven each time, wherein the selection of the two sub-pixels to be simultaneously driven in each pixel is based on a specific sequence.

6. The operation method according to claim 1, further comprising:

driving, when the transflective display apparatus is determined being operated in a transparent mode, the transflective display panel by way of simultaneously driving all of the plurality of sub-pixels in each pixel each time and turning on the backlight module to emit a light emitting through the transparent areas of the driven sub-pixels, thereby configuring the transflective display apparatus to display a colorful image.

7. The operation method according to claim 6, wherein a data voltage, provided to the driven sub-pixels when the transflective display apparatus is operated in the reflective mode, is greater than the data voltage, provided to the driven sub-pixels when the transflective display apparatus is operated in the transparent mode.

8. The operation method according to claim 1, wherein when the transflective display apparatus is operated in the reflective mode, the un-driven sub-pixels are turned off.

9. The operation method according to claim 1, wherein when the transflective display apparatus is operated in the reflective mode, the un-driven sub-pixels are turned on and a voltage difference, between a data voltage provided to the un-driven sub-pixels and a common voltage of the un-driven sub-pixels, is zero.

10. A transflective display apparatus, comprising:

a backlight module;

a transflective display panel, comprising a plurality of pixels, each one of the plurality of pixels comprising a plurality of sub-pixels with different colors, and each one of the plurality of sub-pixels comprising a transparent area and a reflective area;

a scan driver, electrically coupled to the plurality of sub-pixels;

a data driver, electrically coupled to the plurality of sub-pixels; and a timing controller circuit, electrically coupled to the backlight module, the scan driver and the data driver, wherein the timing controller circuit is configured to determine whether the transflective display apparatus is operated in a reflective mode or not, wherein when the transflective display apparatus is determined being operated in the reflective mode, the timing controller circuit is further configured to drive, through the scan driver and the data driver, the transflective display panel by way of driving at least one of the plurality of sub-pixels in each pixel each time and turn off the backlight module, thereby facilitating the transflective display apparatus to display an image by using the reflective areas of the driven sub-pixels to reflect an ambient light of the transflective display apparatus.

11. The transflective display apparatus according to claim 10, wherein when being operated in the reflective mode, the transflective display apparatus is configured to display a single-color image.

12. The transflective display apparatus according to claim 10, wherein when the transflective display apparatus is operated in the reflective mode, the timing controller circuit is further configured to drive, through the scan driver and the data driver, the at least one of the plurality of sub-pixels in each pixel each time in a random manner.

13. The transflective display apparatus according to claim 10, wherein when determining that the transflective display apparatus is operated in the reflective mode, the timing controller circuit is further configured to drive, through the scan driver and the data driver, one of the plurality of sub-pixels in each pixel each time, wherein the selection of the one sub-pixel to be driven in each pixel is based on a specific sequence.

14. The transflective display apparatus according to claim 10, wherein when determining that the transflective display apparatus is operated in the reflective mode, the timing controller circuit is further configured to simultaneously drive, through the scan driver and the data driver, two of the plurality of sub-pixels in each pixel each time, wherein the selection of the two sub-pixels to be simultaneously driven in each pixel is based on a specific sequence.

15. The transflective display apparatus according to claim 10, wherein when determining that the transflective display apparatus is operated in a transparent mode, the timing controller circuit is further configured to drive, through the scan driver and the data driver, the transflective display panel by way of simultaneously driving all of the plurality of sub-pixels in each pixel each time and turn on the backlight module to emit a light emitting through the transparent areas of the driven sub-pixels, thereby configuring the transflective display apparatus to display a colorful image.

16. The transflective display apparatus according to claim 15, wherein a data voltage, provided to the driven sub-pixels when the transflective display apparatus is operated in the reflective mode, is greater than the data voltage, provided to the driven sub-pixels when the transflective display apparatus is operated in the transparent mode.

17. The transflective display apparatus according to claim 10, wherein when the transflective display apparatus is operated in the reflective mode, the timing controller circuit is further configured to turn off the un-driven sub-pixels through the scan driver.

18. The transflective display apparatus according to claim 10, wherein when the transflective display apparatus is operated in the reflective mode, the timing controller circuit is further configured to turn on the un-driven sub-pixels through the scan driver and turn off the data driver.

19. The transflective display apparatus according to claim 10, wherein when the transflective display apparatus is operated in the reflective mode, the timing controller circuit is further configured to turn on the un-driven sub-pixels through the scan driver and control the data driver to provide a data voltage to each un-driven sub-pixel, wherein the data voltage provided to the un-driven sub-pixels has a zero voltage difference with a common voltage of the un-driven sub-pixels.

20. An operation method of a transflective display apparatus, the transflective display apparatus comprising a transflective display panel and a backlight module, the transflective display panel comprising a plurality of pixels, each one of the plurality of pixels comprising a plurality of sub-pixels with different colors, and each one of the plurality of sub-pixels comprising a transparent area and a reflective area, the operation method comprising:

determining whether the transflective display apparatus is operated in a reflective mode or in a transparent mode;

driving, when the transflective display apparatus is determined being operated in the reflective mode, the transflective display panel by way of driving at least one of the plurality of sub-pixels in each pixel each time and turning off the backlight module, thereby facilitating the transflective display apparatus to display an image by using the reflective areas of the driven sub-pixels to reflect an ambient light of the transflective display apparatus; and driving, when the transflective display apparatus is determined being operated in the transparent mode, the transflective display panel by way of simultaneously driving all of the plurality of sub-pixels in each pixel each time and turning on the backlight module to emit a light emitting through the transparent areas of the driven sub-pixels, thereby configuring the transflective display apparatus to display a colorful image;

wherein the transflective display panel has a transparent mode and a reflective mode, the transparent mode and the reflective mode are operated by different driving methods.

* * * * *